US011492224B2

(12) United States Patent
North

(10) Patent No.: US 11,492,224 B2
(45) Date of Patent: Nov. 8, 2022

(54) MAGAZINE

(71) Applicant: Ivan North, St. Charles, MO (US)

(72) Inventor: Ivan North, St. Charles, MO (US)

( * ) Notice: Subject to any disclaimer, the term of this patent is extended or adjusted under 35 U.S.C. 154(b) by 141 days.

(21) Appl. No.: 16/864,939

(22) Filed: May 1, 2020

(65) Prior Publication Data

US 2020/0346882 A1 Nov. 5, 2020

Related U.S. Application Data

(60) Provisional application No. 62/842,102, filed on May 2, 2019.

(51) Int. Cl.

| | |
|---|---|
| ***B65H 16/02*** | (2006.01) |
| ***B65H 16/06*** | (2006.01) |
| ***B65H 19/12*** | (2006.01) |
| ***B65H 27/00*** | (2006.01) |

(52) U.S. Cl.

CPC ..... *B65H 16/023* (2013.01); *B65H 16/06* (2013.01); *B65H 19/126* (2013.01); *B65H 27/00* (2013.01); *B65H 2403/41* (2013.01); *B65H 2403/44* (2013.01); *B65H 2551/12* (2013.01); *B65H 2701/1944* (2013.01)

(58) Field of Classification Search

None

See application file for complete search history.

(56) References Cited

U.S. PATENT DOCUMENTS 1,009,827 A * 11/1911 Capers ..... A47F 7/175 242/594.6
1,626,574 A * 4/1927 Jackson ..... B41L 5/06 462/29
2,154,440 A * 4/1939 Crotts ..... B65H 16/021 242/419.4
2,391,265 A * 12/1945 Palmer ..... B65H 16/021 242/596.6
5,011,059 A * 4/1991 Jennings, Jr ..... B65H 35/0006 225/35
8,540,182 B2 * 9/2013 Martineck, Sr. ..... G07B 3/02 242/594.4

(Continued)

FOREIGN PATENT DOCUMENTS

DE 202013105606 * 5/2014

OTHER PUBLICATIONS

English Translation of DE 20 2013 105 606, Emsa, May 2014 (Year: 2014).*

*Primary Examiner* — William A. Rivera

(74) *Attorney, Agent, or Firm* — Charles McCloskey

(57) ABSTRACT

A magazine has a generally rectangular, prismatic shaped body with a lid. The body has a front with an opening, an opposite back, a bin upon the back, a left side and an opposite right side spanning from the front to the back, a toothed rack on each side, a spindle assembly between the two racks, and a base beneath the front, the back, and the two sides. The lid rests upon the front, the back, the left side, and the right side in a spacing above the base. Each spindle of the assembly receives a roll of wrapping paper, oriented parallel to the front. Each spindle has an end cap and an opposite movable cap engaging a dock upon a cover. The spindles rotate upon gears with the spindle assembly upon the racks. Grips upon each spindle allow a user to unroll paper as desired.

11 Claims, 11 Drawing Sheets

(56) References Cited

U.S. PATENT DOCUMENTS

| | | | | |
|---|---|---|---|---|
| 2004/0144882 | A1* | 7/2004 | Small | B65B 67/08<br>242/559 |
| 2005/0127083 | A1* | 6/2005 | Russell | B65H 35/002<br>221/30 |
| 2006/0016153 | A1* | 1/2006 | King | B65H 35/002<br>53/390 |
| 2008/0265084 | A1* | 10/2008 | Hammer | B65H 16/021<br>242/557 |

* cited by examiner

MAGAZINE

CROSS-REFERENCE TO RELEATED APPLICATIONS

This non provisional application claims priority to provisional application Ser. No. 62/842102 filed on May 2, 2019 which are owned by the same inventors.

BACKGROUND OF THE INVENTION

The magazine generally relates to wrapping paper and more specifically to a container of multiple rolls of wrapping paper.

Every year they come, birthdays, anniversaries, Christmas, Hanukah, promotions, new jobs, and many other events. These events often have presents large and small. To add the element of surprise to the present, a gift giver often has a present wrapped. The wrapping may make many forms.

Wrapping includes a box, a cloth, a bag, a bow, and more often paper. The wrapping seeks to conceal the present from view of the recipient. Wrapping paper has a generally elongated sheet form with printing in various forms upon one side. The printing has a suitable layout, coloration, decoration, and typeface for an occasion such as birthdays, anniversaries, Christmas, Hanukah, promotions, new jobs, and many others. The printing on wrapping papers has numerous forms.

As paper, wrapping papers has two primary forms when provided to a consumer. Sheets of wrapping paper may be stacked and then folded into a compact, flat form, or more often it may be rolled upon a tube. A roll of wrapping paper has a typical width of nearly three feet, or similar to two shirt boxes form a department store. The roll may then include a length of wrapping paper measure in yards, typically less than ten yards.

When the time comes to wrap a present, a consumer purchases a roll of wrapping paper or retrieves an existing roll, and then unrolls a portion of the wrapping paper. The consumer then measures the wrapping paper to cover the present and then cuts the wrapping paper with scissors or other tools. The consumer then wraps and folds the paper upon the present, securing the paper with transparent tape, adhesive, and the like. The consumer then returns unused wrapping paper and the cutting tools to storage for the next use. At the appointed time, the consumer then gives the present to the recipient for enjoyment.

DESCRIPTION OF THE PRIOR ART

As previously mentioned, unused wrapping paper returns to storage after its use. Typically, a consumer tightens the wrapping paper upon the roll and then places the roll in a seldom visited place. Because of the slender shape, length, and stiffness of wrapping paper rolls, a consumer has limited places to store wrapping paper.

A consumer may place wrapping paper rolls under a bed, behind a door, in a closet, up in an attic, down in the basement, or other places. There the rolls rest until their next use. Some locations do expose the rolls to the heat of an attic or the coolness of a basement. When an occasion comes, a consumer then has to retrieve the rolls, select a roll, then open the roll upon a table for cutting.

The prior art includes various devices. Polymer storage containers have various shapes and sizes so the larger ones receive multiple rolls of wrapping paper. The rolls generally fit into such containers in no particular order. Some containers have a long but short form suitable for under bed storage. Those containers only store a few rolls beneath their long lid. Other containers have a tall, upright form upon an oval base. These containers store a few rolls on their ends and often have a cap with an enclosed shelf upon it. These upright containers store the rolls in no particular order. The upright containers also have a tendency to tip over, especially with fewer rolls within them.

The prior art may also utilize moving boxes, wardrobe boxes, crates, and other bulk packaging to store the long slender rolls of wrapping paper. Though these packages may store rolls, the rolls have an awkward fit into the packages that takes up much space. These packages often lack a compact form and also promote disorder of rolls stored within in them.

SUMMARY OF THE INVENTION

The invention of the magazine has a generally rectangular, prismatic shaped body with a lid. The body has a front with an opening, an opposite back, a bin upon the back, a left side and an opposite right side spanning from the front to the back, a bearing on each side, a spindle assembly between the two bearings, and a base beneath the front, the back, and the two sides. The lid rests upon the front, the back, the left side, and the right side in a spacing above the base. Each spindle of the assembly receives a roll of wrapping paper upon it, oriented parallel to the front. The spindles rotate in two holders that rotate the spindle assembly upon the bearings.

There has thus been outlined, rather broadly, the more important features of the invention in order that the detailed description thereof that follows may be better understood and that the present contribution to the art may be better appreciated. The present invention also includes guides in a path, spacers between adjacent guides, folding handles, a tape dispenser, a curved grip upon the front, a cutter upon the lid, trapezoidal shaped sides, and an alternate hinged lid. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a magazine that rotates rolls of wrapping paper for selection by a user.

Another object is to provide such a magazine that stores at least four rolls of wrapping paper.

Another object is to provide such a magazine that provides a cutter for a user to cut the width of a sheet of wrapping paper.

Another object is to provide such a magazine that has a measuring scale upon its lid.

Another object is to provide such a magazine that provides a bin for storing bows and other items and an onboard tape dispenser.

Another object is to provide such a magazine that is capable of manufacturing and distribution at a price suitable for the users, customers, supply houses, retailers, distributors, and catalogs.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
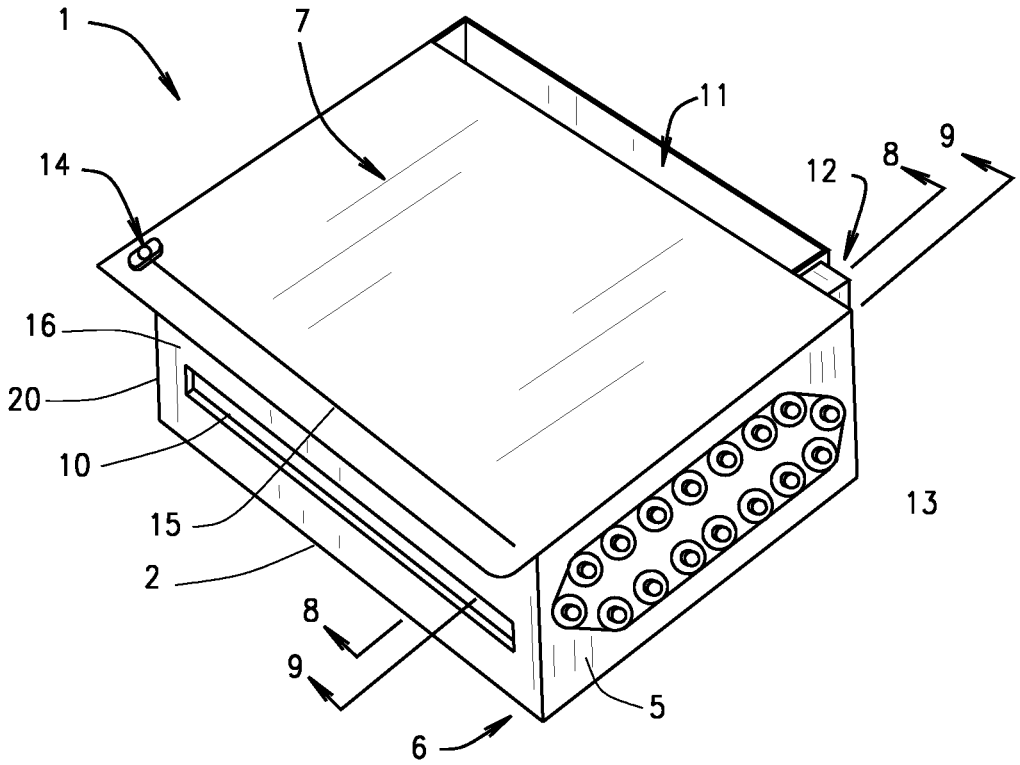
FIG. 1 is a perspective view of an alternate embodiment of the magazine of the invention.

The present invention overcomes the prior art limitations by providing a magazine that stores rolls of wrapping paper. An alternate embodiment of the present invention 1 appears as shown in FIG. 1 in the form of a generally trapezoidal, prismatic shaped body 20 with a lid 7 upon it. The body has a rectangular front 2 with a rectangular opening 10 in it that provides access to the interior of the body 20. The front has its width and its height where the height defines the height of the invention. Proximate the lid, the front has a grip 16 formed into it lengthwise as later shown. Mutually parallel and spaced apart from the front, the body has a back 3 also rectangular in shape with a similar height to that of the front. The back has upon it a bin 11 the extends for more than half of the width of the back. The bin has its height slightly less than that of the back. The bin remains open outwardly for the lid.

Spanning from the front to the back, the body has its left side 4 of a trapezoidal like shape with its depth front to back and height similar to that of the front. Mutually parallel and spaced apart from the left side, the body has its right side 5 also of a rectangular shape of the same depth and height as the left side. The left side 4 and the right side 5, as shown in this figure, each have a track assembly 13 here shown on end. A track assembly 13 spans each side and occupies most of the depth and the height of the side. Each track assembly has a plurality of holders connecting to it and the holders follow a path as later shown. The holders gently move along the track assemblies as a user pushes them to select a roll of wrapping paper for usage.

Between the bin 11 and the right side 5, the back has a tape dispenser 12 preferably formed therein but alternatively adhered to the back or mechanically connected to the back. The tape dispenser has a location proximate the lid and its own height less than that of the back. Spaced below the tape dispenser, the body 20 has its base 6 of a planar rectangular form with four edges. The base 6 joins to the front 2, the back 3, and the two sides 4, 5, along its edges so that the front, the back, and the sides have a spacing apart defining a volume within the body to receive the holders and wrapping paper. Spaced above the base 6 by the height of the front, the invention 1 has its lid 7. The lid has a generally planar rectangular shape with a slightly larger width than that of the front and a longer depth than that of the left side and the right side. The lid extends from the back, over the holders, to the front, and slightly past the front. The lid has a cutter 14 positioned above where the lid rests upon the front and located near the left side in this figure. The cutter follows a linear track 15 along the lid generally parallel to the front. The linear track extends for most of the width of the front thus having sufficient length to exceed the width of a wrapping paper roll.

Figure 2:
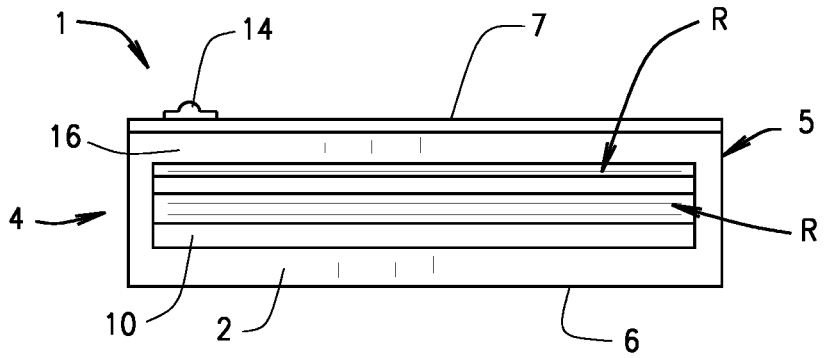
FIG. 2 is a front view.

Turning to FIG. 2, it shows the invention 1 in a front view as a user would see it in preparation for usage, such as when pulling the invention from a closet or other storage. The body 20 has its front 2 shown in this figure. The front has its width that spans from the left side 4 to the right side 5 and its height that spans from the base 6 upwardly to the lid 7. Generally centered upon the height and the width of the front, it has the opening 10. The opening has a rectangular shape of less height than the front and of sufficient length to pass the edge of wrapping paper from a roll. Within the opening, this figure shows two rolls R ready for usage. The lid has its cutter 14 here shown towards the left and extending slightly above the plane defined by the lid. The grip 16 extends across the width of the front and provides a surface for a user to grasp during usage of the invention.

Figure 3:
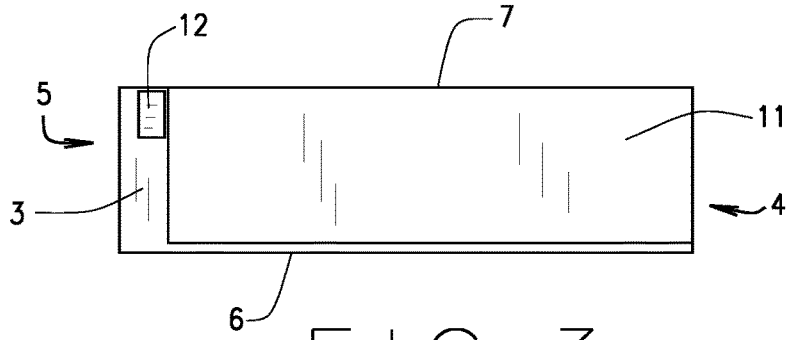
FIG. 3 is a rear view.

Opposite FIG. 2, FIG. 3 then shows a back view of the invention 1 with the bin 11 forward in this figure. The bin has a generally rectangular shape that extends from the left side 4 partially across the width of the back 3 leaving a portion of the back visible towards the right. The bin extends for nearly the full height of the back and spans from the plane of the lid 7 towards the base 6. Outwardly from the bin, that is, towards the right side 5, the body has its tape dispenser 12. The dispenser has sufficient width and depth to receive a roll of transparent tape from which a user draws during wrapping of a present. The dispenser includes a cutting edge, not shown, for separating a piece of tape at a desired length.

Figure 4:
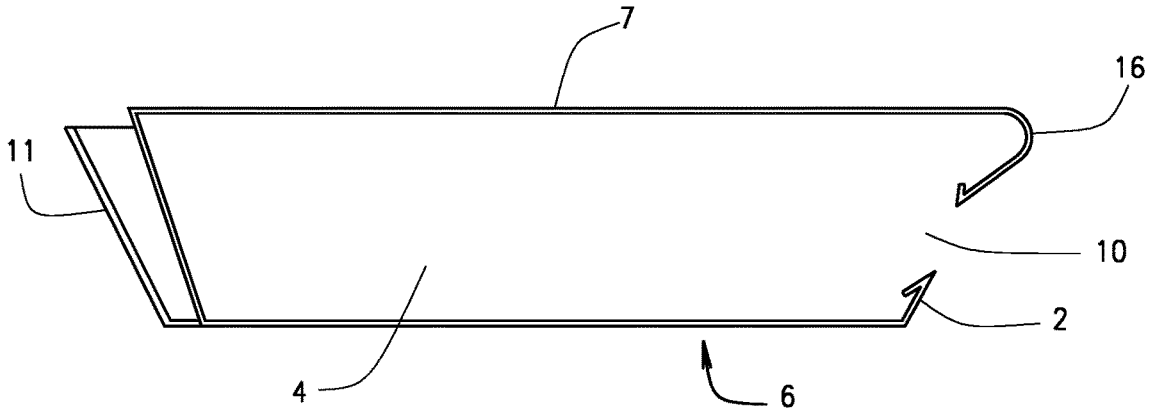
FIG. 4 is an enlarged left side view.

Rotating the body 20, FIG. 4 shows a side view of the invention 1 with the left side 4 forward. The left side has a generally trapezoidal shape with a height and a width defined by that of the lid 7. From the left in this figure, the left side 4 has the bin 11 extending outwardly from the back and slightly below the plane of the lid 7. The bin has its own depth, markedly less than the width of the left side. The bin has its depth and width to receive bows, ribbon rolls, and other items helpful during usage of the invention as a wrapping station. From the bin, the left side continues with its height and width where the width allows for storage of many rolls of wrapping paper. Opposite the bin, the left side has the front 2. The front follows the trapezoidal shape of the left side and orients upward and rightward in this figure. The front has the opening 10 here shown on edge as an interruption in the front. The opening has finished edges, here shown as folded back, that prevent tearing of wrapping paper as it passes through the opening. Above the opening, the front has the grip 16. The grip appears as a rounded surface outwardly of the base below. The grip allows a user to draw wrapping paper upon and around it so the paper lays flat and taught upon the lid for measuring and later cutting. The rounded surface has a radius of curvature greater than its length.

Figure 5:
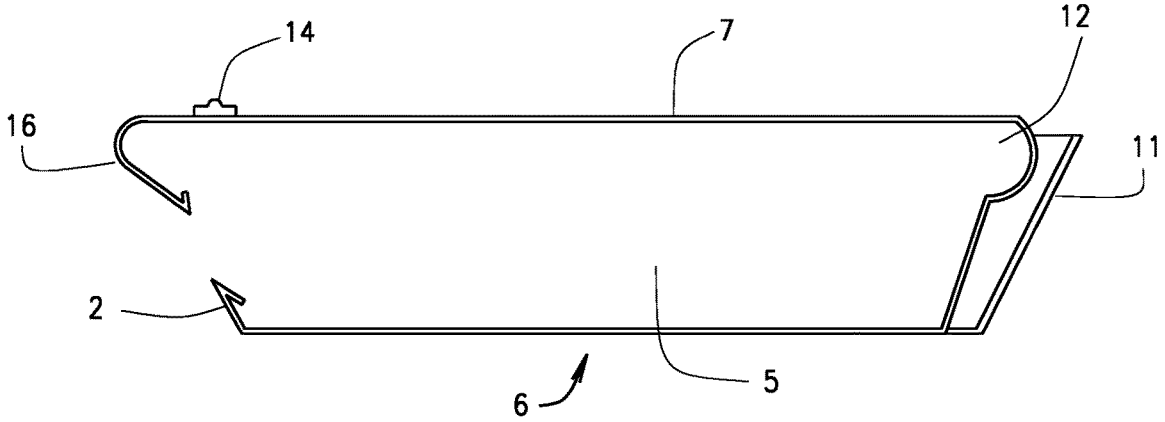
FIG. 5 is an enlarged right side view, opposite FIG. 4.

FIG. 5 then describes the Magazine for wrapping paper invention 1 in a side view opposite that of FIG. 4. This figure has the right side 5 forward and thus visible. And with the front 2 to the left, the right side has the grip 16 above the opening. The grip surface rotates to just beneath the plane of the lid 7 proximate the cutter 14 here shown in this figure as pulled to the right of the track 15. The lid continues rearward towards the right in this figure and then ends at the back. Outwardly from the lid, the back has the tape dispenser 12 that descends a portion of the height of the back. Behind the tape dispenser, that is, into the plane of this figure, the back has the bin 11 here shown on edge. The back and nearly the bin descend to the base 6 at the bottom of the body 20. The base has its position generally mutually parallel to and spaced below the lid.

Figure 6:
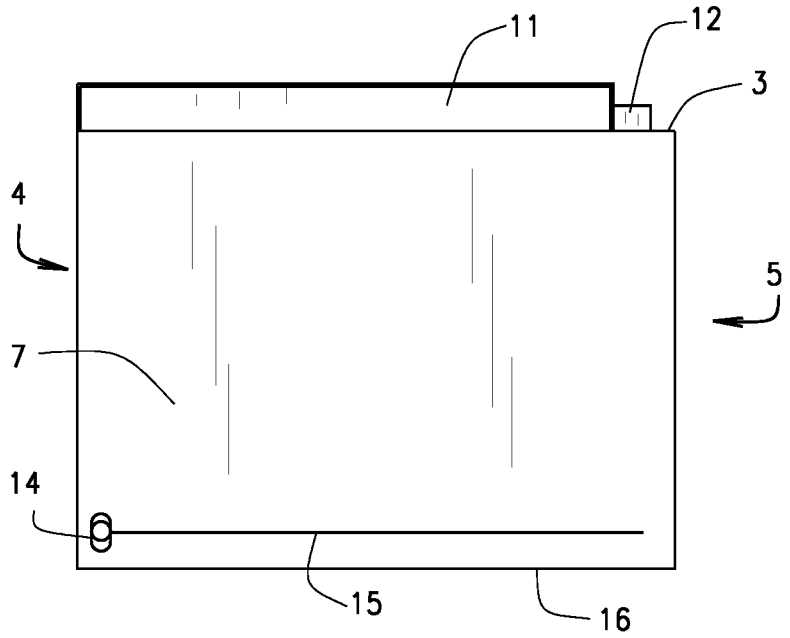
FIG. 6 is a top view.

Turning the invention, FIG. 6 shows a top view of it with the lid 7 in the foreground. The lid has a generally rectangular form that fits upon the back, the left side, the right side, and over the front. The lid extends towards the grip 16. The lid has its width generally slightly more than that of the front and its depth generally slightly more than that of the left side and of the right side opposite the base. Towards the grip 16, that is, the bottom of this figure, the lid has the cutter 14, here shown towards the left, as the end of the track 15. The track extends parallel to the front, that is, the grip 16 for a length sufficient to admit the width of a sheet of wrapping paper. Opposite the track, the lid has the bin 11 behind it for most of the back 3 and the dispenser 12 fits into the corner formed between the bin and the back. The dispenser leaves a portion of the corner exposed thus making the back visible. In an alternate embodiment, the lid has a measuring scale formed into it proximate the left side. In a further alternate embodiment, the lid has integral measuring scales near the left side and the right side.

Figure 7:
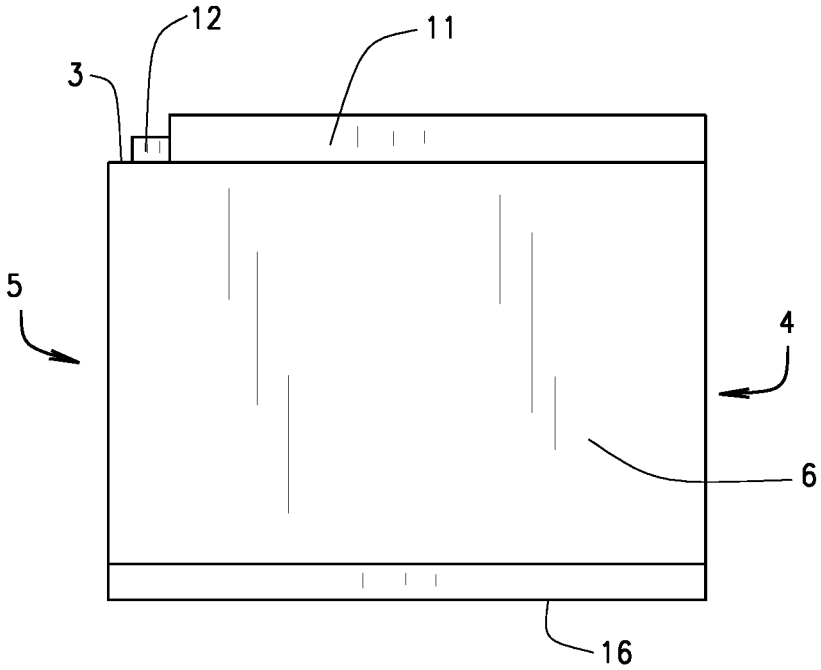
FIG. 7 is a bottom view.

And turning the invention 1 over, the body 20 appears next in FIG. 7 with the base 6 in the foreground. The base also has a rectangular shape with a width similar to that of the front and a depth similar to that of the left side 4 and of the right side 5 opposite the lid, not shown. Proximate the front, the body has the grip 16 visible beneath the base in this figure as the grip extends toward the user as previously shown in FIGS. 4, 5. Opposite the grip, the body has the bin 11 approaching the base. Outwardly from the bin towards the right side 5, the body has the tape dispenser 12 shown upon the back 3. The tape dispenser does not reach the base in this embodiment of the invention.

Figure 8:
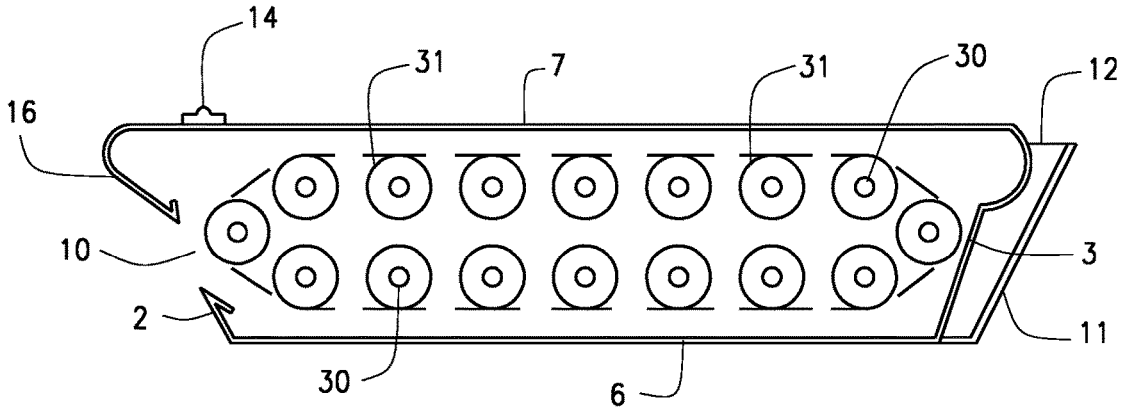
FIG. 8 is a sectional view inward of the right side.

Looking at the mechanism of the invention to assist the user in selecting stored wrapping paper, FIG. 8 then displays a sectional view of the Magazine inwardly from the right side 5. The body has a volume defined by the base 6, the front 2, the lid 7, and the back 3. In this view the back has upon it the tape dispenser 12 and the bin 11 as previously described and the front has the grip 16 upon it. Within that volume, the body has a plurality of holders 31 with each holder having an end with a roller 30 upon it. Each holder has an elongated cylindrical form with a lengthwise slot. Each holder than receives a roll of wrapping paper placed therein. The body has its volume that has space for at least eight and preferably sixteen holders as shown. The holders, with the wrapping paper in them, rotate individually for insertion and removal of a roll and for drawing out an edge of a roll for measuring and cutting. The drawing out occurs when a holder is placed proximate the opening 10 in the front 2.

Figure 9:
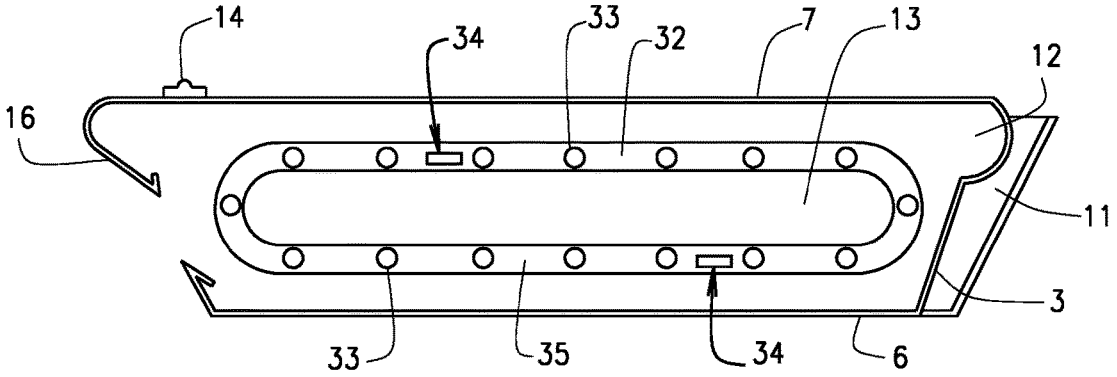
FIG. 9 is a sectional view proximate the right side.

To reach the drawing out position of a holder, a user moves the holders using the mechanism shown in FIG. 9. FIG. 9 has a sectional view of the Magazine at the right side 5 showing a track assembly 13. The track assembly has a generally oval track 32 with two mutually parallel and spaced apart portions. The spacing between these portions slightly exceeds the diameter of a full roll of wrapping paper so that the holder may pass each other. The parallel portions then have a continuous connection with two curved portions to complete the oval. The curved portions have a radius proportional to the radius of a full roll of wrapping paper so that the holders may pass from one parallel portion to the other without binding in the curved portions. Within the track 32, the track assembly 13 has a plurality of guides 33 with each guide having an adjacent spacer 35. The adjacent spacer and guide together establish an interval between consecutive guides of approximately one diameter of a full roll of wrapping paper. The interval allows for storage of rolls and then their movement during selection for drawing out to cut. The spacer may have the form of a separate piece that fills a gap between adjacent guides, of an extension joined to a guide, or of a belt that receives the guides but permits their rotation. Select spacers may have a substitute with a handle suitable for grasping by a user. The track assembly has at least one handle, with two handles shown in this figure. The Applicant foresees a number of handles sufficient so one handle is in a parallel portion, particularly the portion proximate the lid, at all times during usage.

In a further alternate embodiment, the left side and the right side have slots in them so a user may grasp the handles outside the magazine. In this further alternate embodiment, the track assemblies join to the left side and the right side.

In a further alternate embodiment, the track assembly has ferrous spacers that attract to a magnetic handle a user grasps outside the left side and the right side. The user then slides the handle in a desired direction to advance the holders around the track assembly.

In a further alternate embodiment, the track assemblies have locations inwardly of the left side and the right side. The track assemblies attached to mounts formed into the base. The track assemblies then have outward handles a user may grasp just inside of the left side and the right side. In a further alternate embodiment, as most people are right handed, the invention has handles proximate the right side only.

Figure 10:
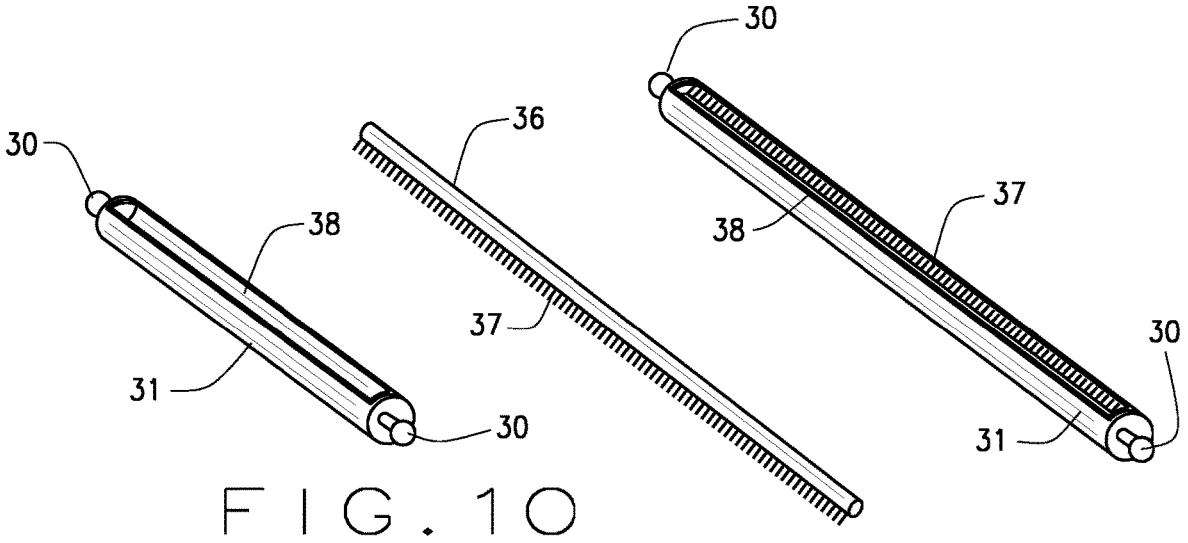
FIG. 10 is an exploded perspective view of a holder of the invention.

FIG. 10 shows an exploded view of the holder 31 of the invention. From the left, a holder 31 has an elongated, hollow, cylindrical form with a lengthwise slot 38. The holder has a length at least four times that of its diameter. The slot 38 extends for nearly the length of the holder. The holder closes the slot at two opposing ends with rollers 30. Each end has a roller 30 that engages a guide 33 of the track assembly 13 previously described. The rollers connect to the guides so that the holders do not fall from the track assembly yet the rollers do rotate as the user moves the holders around the track 32. In an alternate embodiment, the rollers join to the guides in a permanent connection so that the rollers and their holders become a part of the track assembly thus forming a large unit installed into the body 20 of the invention for this alternate embodiment.

The slot 38 of a holder receives a strip 36 joined or adhered lengthwise to one edge of the slot. The strip has a thin elongated, flat form with a plurality of tines 37 mutually extending in the same direction. The tines have a semi rigid form that guides paper pulled beneath them to remain taught. The tines also guide a user to pull the paper in the same direction from each holder. The tines have a length greater than the width of the strip as shown. The tines have a spacing between any two adjacent tines of at least two tine diameters. Each tine has a tip of a blunt square shape to limit penetration of a sheet of paper during its pull and unrolling from the holder. In an alternate embodiment, the tines have a rigid form with a thin tip. In an alternate embodiment, the tines have a flexible form and either a round cross section or a rectangular cross section. And, the strip 36 joins to one edge of the slot 38 with the tines facing into the slot. The tines nearly block the slot but leave enough room for a user to find the edge of a wrapping paper roll and to accommodate the wrapping paper roll deflecting during unrolling.

Figure 11:
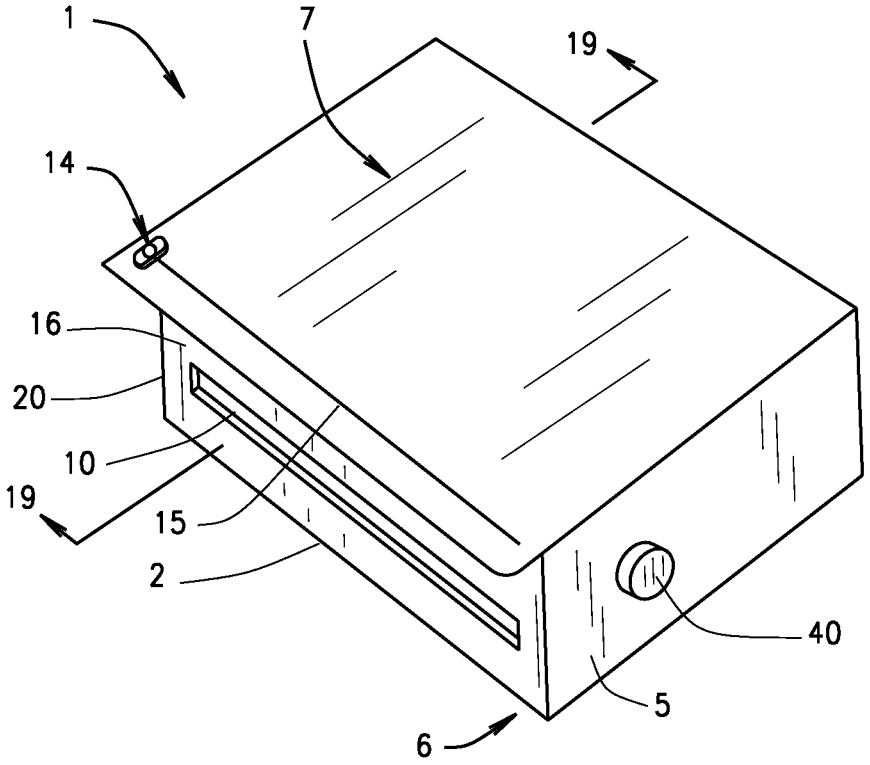
FIG. 11 is a perspective view of a preferred embodiment of the magazine of the invention.

A preferred embodiment of the present invention 1 appears in FIG. 11 as a generally trapezoidal, prismatic shaped body 20 with a lid 7 upon it. The body has a rectangular front 2 with a rectangular opening 10 in it that provides access to the interior of the body 20. The front has its width and its height where the height defines the height of the invention. Proximate the lid, the front has a grip 16 formed into it lengthwise as later shown. Mutually parallel and spaced apart from the front, the body has a back 3 also rectangular in shape with a similar height to that of the front. The back has upon it a second rectangular opening shorter than the opening 11 in the front. The second opening appears in later figures.

Spanning from the front to the back, the body has its left side 4 of a trapezoidal like shape with its depth front to back and height similar to that of the front. Mutually parallel and spaced apart from the left side, the body has its right side 5 also of a rectangular shape of the same depth and height as the left side. The left side 4 and the right side 5, as shown in this figure, each have a bearing 40 here shown on end. Each bearing has an off center location upon the left side and the right side generally towards the opening 10. The bearing has a spindle assembly, later shown, that occupies most of the depth and the height of the side.

Spaced below the front and the right side, the body 20 has its base 6 of a planar rectangular form with four edges. The base 6 joins to the front 2, the back 3, and the two sides 4, 5, along its edges so that the front, the back, and the sides have a spacing apart defining a volume within the body to receive the spindle assembly, wrapping paper, and related materials and tools. Spaced above the base 6 by the height of the front, the invention 1 has its lid 7. The lid has a generally planar rectangular shape with a slightly larger width than that of the front and a longer depth than that of the left side and the right side. The lid extends from the back, over the spindle assembly, to the front, and slightly past the front. The lid has a grid pattern upon its surface, typically upon a one inch spacing or alternatively on a one centimeter spacing. The lid has a cutter 14 positioned above where the lid rests upon the front and located near the left side in this figure. The cutter follows a linear track 15 along the lid generally parallel to the front. The linear track extends for most of the width of the front thus having sufficient length to exceed the width of a wrapping paper roll.

Figure 12:
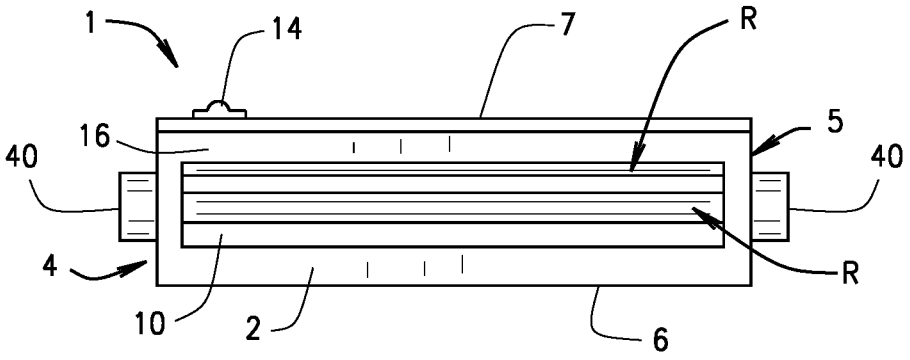
FIG. 12 is a front view of FIG. 11.

Turning to FIG. 12, it shows the invention 1 in a front view as a user would see it in preparation for usage, such as when pulling the alternate embodiment of the invention from a closet or other storage. The body 20 has its front 2 shown in this figure. The front has its width that spans from the left side 4 to the right side 5 and its height that spans from the base 6 upwardly to the lid 7. Generally centered upon the height and the width of the front, it has the opening 10. The opening has a rectangular shape of less height than the front and of sufficient length to pass the edge of wrapping paper from a roll. Within the opening, this figure shows two rolls R ready for usage. The rolls rest upon the spindle assembly that turns upon the bearings 4 in each side as shown. The lid has its cutter 14 here shown towards the left and extending slightly above the plane defined by the lid. The grip 16 extends across the width of the front and provides a surface for a user to grasp during usage of the invention.

Figure 13:
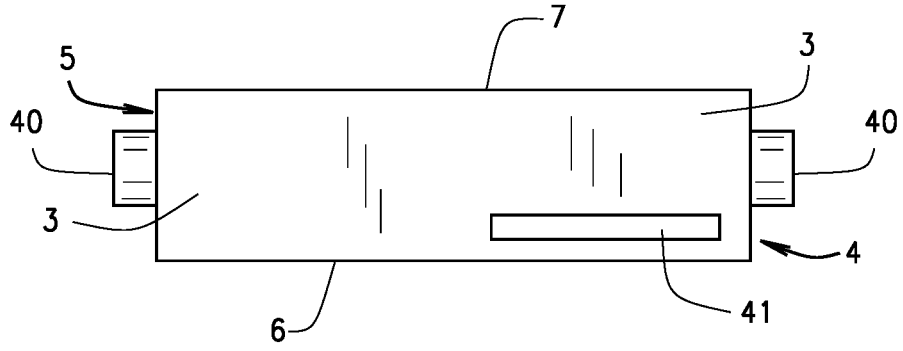
FIG. 13 is a rear view of FIG. 11.

Opposite FIG. 12, FIG. 13 then shows a back view of the alternate embodiment of the invention 1 with the back 3 forwardly in this figure. The back has its generally rectangular shape that extends from the left side 4 towards the right side 5. Through the back near the left side, the body has the second opening 41 that provides access into a portion of the body. The second opening has its length less than half of that of the back. The second opening has a narrow rectangular shape generally oriented parallel to the base 6. The opening has is leftmost edge generally centered upon the back 3 and opening ends short of the left side 4 here shown on the right of the figure. The second opening allows for passage of ribbon and other materials through it. In an alternate embodiment, the second opening has a ribbon guard with a thin slot therein.

Figure 14:
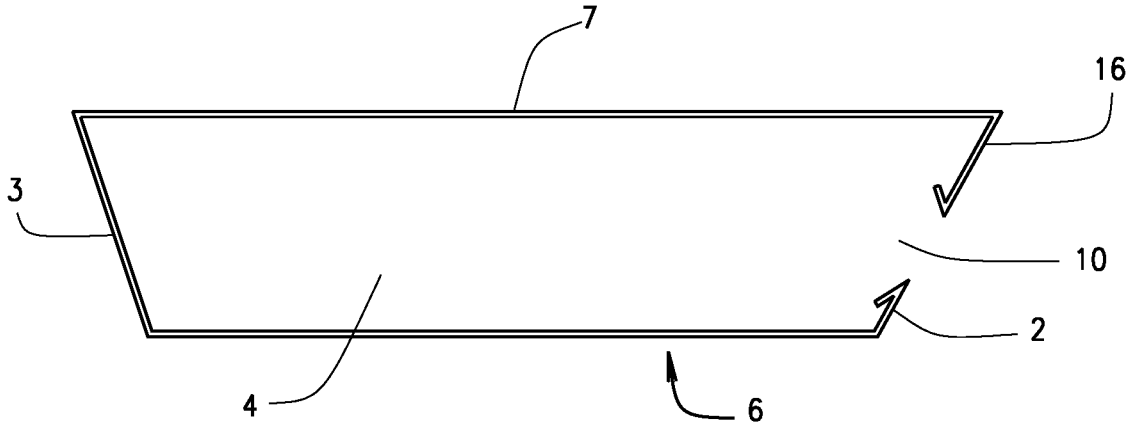
FIG. 14 is an enlarged left side view of FIG. 11.

Rotating the body 20, FIG. 14 shows a side view of the alternate embodiment of the invention 1 with the left side 4 forward. The left side has a generally trapezoidal shape with a height and a width defined by that of the lid 7. From the left in this figure, the left side 4 has the back 3 here shown on edge and extending outwardly and slightly below the plane of the lid 7. From the back, the left side continues with its height and width where the width allows for storage of many rolls of wrapping paper. Opposite the back, the left side has the front 2. The front follows the trapezoidal shape of the left side and orients upward and rightward in this figure. The front has the opening 10 here shown on edge as an interruption in the front. The opening has finished edges, here shown as folded inwardly, that prevent tearing of wrapping paper as it passes through the opening. Above the opening, the front has the grip 16. The grip appears as a rounded surface outwardly of the base below. The grip allows a user to draw wrapping paper upon and around it so the paper lays flat and taught upon the lid for measuring and later cutting. The rounded surface has a radius of curvature greater than its length. In a further alternate embodiment, the opening 10 and the second opening 41 have at least one strip of a contrasting color from that of the front and the back respectively.

Figure 15:
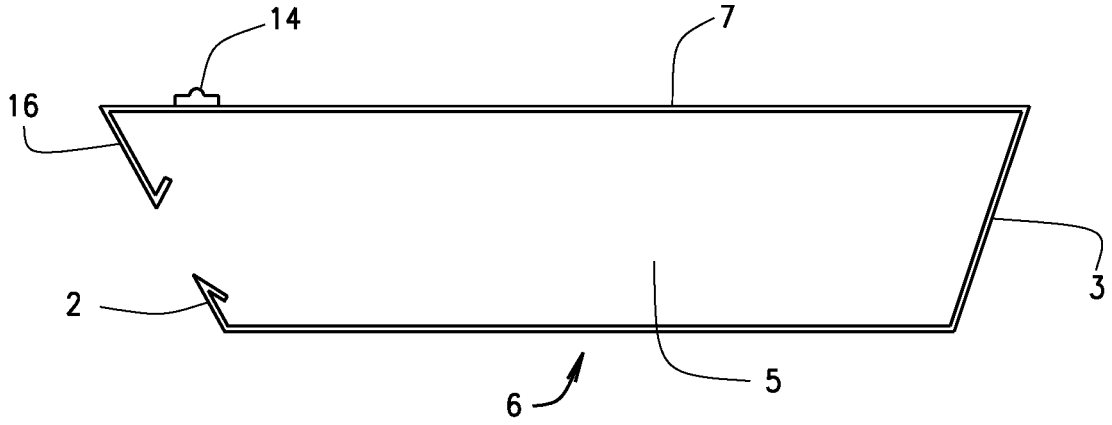
FIG. 15 is an enlarged right side view of FIG. 11, opposite FIG. 14.

FIG. 15 then describes the preferred embodiment of the magazine for wrapping paper invention 1 in a side view opposite that of FIG. 14. This figure has the right side 5 forward and thus visible. And with the front 2 to the left, the right side has the grip 16 above the opening. The grip surface rotates to just beneath the plane of the lid 7 proximate the cutter 14 here shown in this figure as pulled to the right of the track 15. The lid continues rearward towards the right in this figure and then ends at the back. The back descends to the base 6 at the bottom of the body 20. The base has its position generally mutually parallel to and spaced below the lid.

Figure 16:
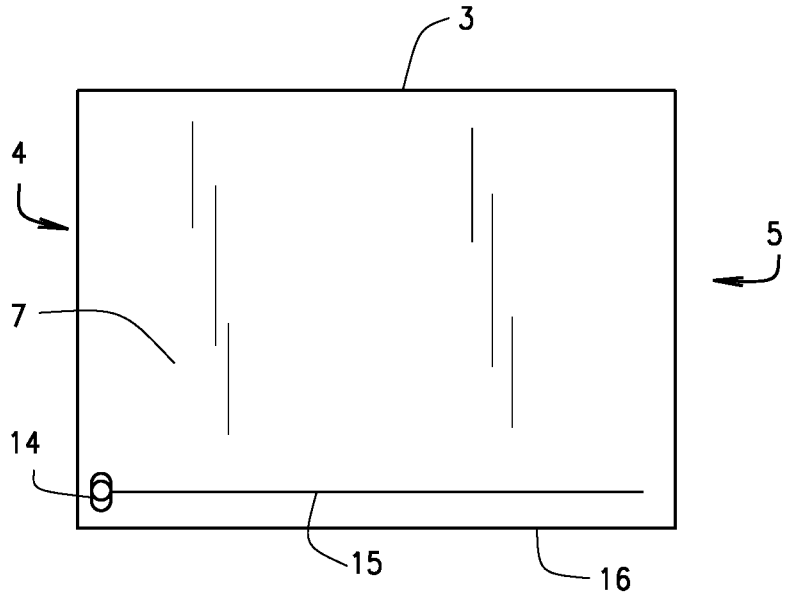
FIG. 16 is a top view of FIG. 11.

Turning the preferred embodiment of the invention, FIG. 16 shows a top view of it with the lid 7 in the foreground. The lid has a generally rectangular form that fits upon the back, the left side, the right side, and over the front. The lid extends towards the grip 16. The lid has its width generally slightly more than that of the front and its depth generally slightly more than that of the left side and of the right side opposite the base. Towards the grip 16, that is, the bottom of this figure, the lid has the cutter 14, here shown towards the left, as the end of the track 15. The track extends parallel to the front, that is, the grip 16 for a length sufficient to admit the width of a sheet of wrapping paper. In an alternate embodiment, the lid has a measuring scale formed into it proximate the left side. In a further alternate embodiment, the lid has integral measuring scales near the left side and the right side.

Figure 17:
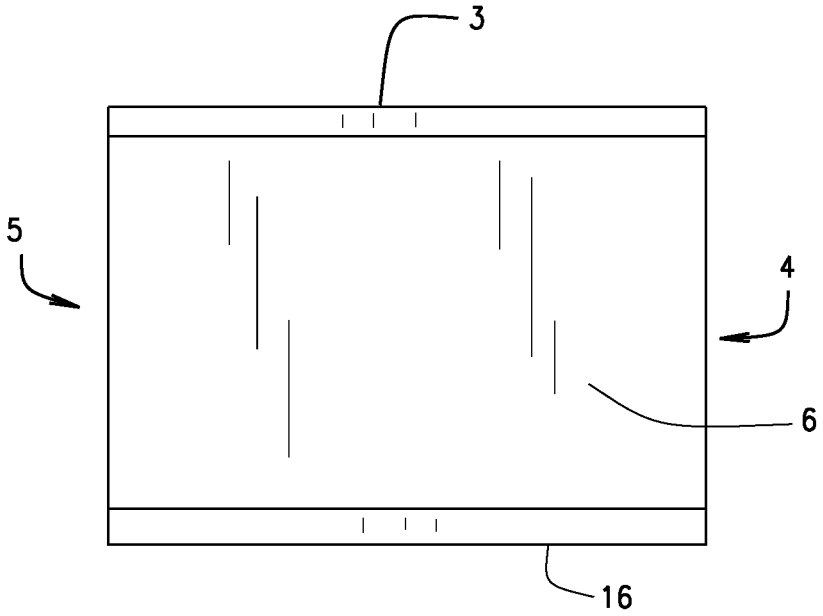
FIG. 17 is a bottom view of FIG. 11.

Inverting the preferred embodiment of the invention 1, the body 20 appears next in FIG. 17 with the base 6 in the foreground. The base also has a rectangular shape with a width similar to that of the front and a depth similar to that of the left side 4 and of the right side 5 opposite the lid, not shown. Proximate the front, the body has the grip 16 visible beneath the base in this figure as the grip extends toward the user as previously shown in FIGS. 4, 5.

Figure 18:
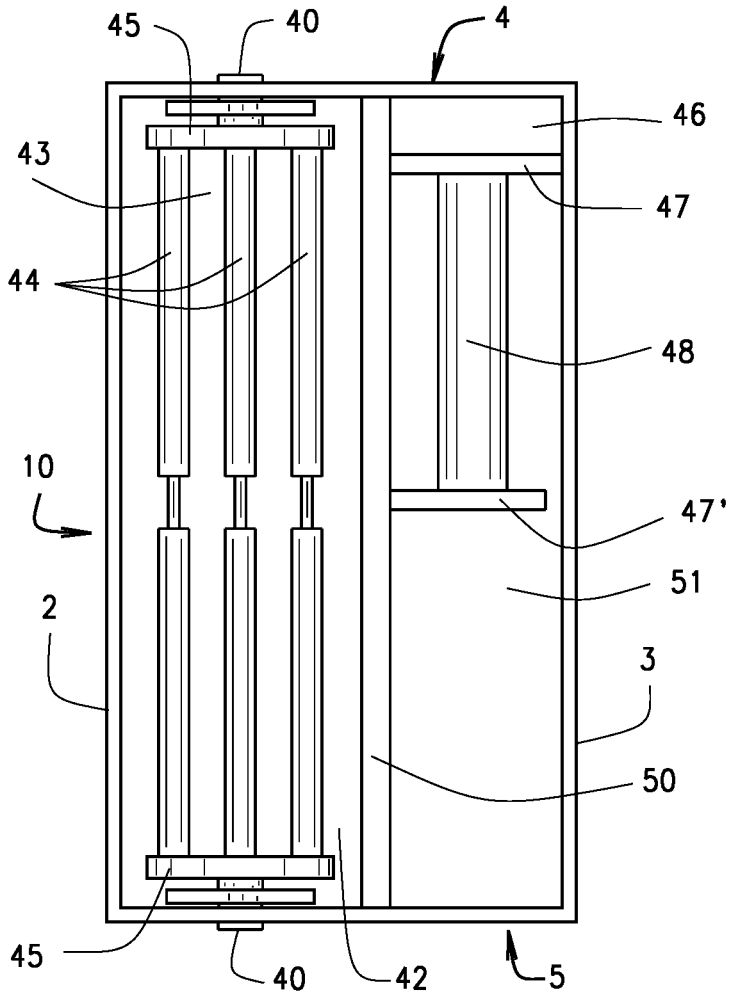
FIG. 18 is a top view of FIG. 11 with the lid removed.

FIG. 18 provides a top view of the preferred embodiment of the invention with the lid 7 removed and the bottom 6 inward from the plane of the figure. This view shows the internal components of the preferred embodiment with rolls R of wrapping paper excluded. Inwardly from the front 2 and the opening 10, the preferred embodiment has a main compartment 42 extending across the length of the body 20. The main compartment has a depth approximately half the width of the left side and the right side. The main compartment receives a spindle assembly 43. The spindle assembly has at least three spindles 44, preferably six spindles, two holders 45 with one upon each end of the spindles as shown, and two bearings 40 operatively connected to each holder. Each spindle receives a roll's worth of paper rerolled upon it by the user. Each spindle then rotates within its connection to the holders. And each holder rotates upon its adjacent bearing thus the entire spindle assembly 43 rotates within the main compartment and each spindle rotates within the spindle assembly. Rotating the spindle assembly allows a user to select wrapping paper for cutting and rotating one spindle allows a user to withdraw wrapping paper from the spindle through the opening 10 for cutting to size.

Inwardly from the spindle assembly, the preferred embodiment has a major divider 50. The major divider extends for the length of the body and spans from the left side to the right side. The major divider has its own height that spans from the base to the rim of the body, just below the lid. The major divider has its thickness, generally more than the front and its thickness is markedly less than its length. The front and the major divider define the main compartment 42. Clockwise in this figure from the spindle assembly, the body has a fourth compartment 46 adjacent to the left side 4. The fourth compartment extends inwardly, here shown as downward in the figure, to a minor divider 47. The minor divider spans from the major divider to the back 3. The minor divider has similar thickness as the major divider and less length than the major divider. The minor divider extends upwardly from the base to the rim of the body and forms a plane with the major divider. The fourth compartment spans for about half the width of the left side and less than one third of that dimension inwardly from the left side. The fourth compartment has a narrow shape.

The minor divider 47 near the fourth compartment connects to the major divider and receives a rod 48 generally centered upon the minor divider 47. The rod extends to a second minor divider 47 approximately centered upon the length of the body as shown. The rod has a diameter generally more than the diameter of a spindle. As the spindles receive rolls of paper, the rod receives rolls of ribbon, webbing, and fabric tape. The rod has a bolted connection to its minor dividers so a user need only remove a nut from the connection to slip the rod away from a minor divider to insert a roll of tape. As shown, the rod 48 spans between two minor dividers 47. Clockwise from the fourth compartment, the two minor dividers, the major divider, and the back define a second compartment 49. The second compartment is the same width as the fourth compartment but of greater length. Clockwise from the second compartment, the second minor divider, the major divider, and the back define the third compartment 51. The third compartment has the same width as the second compartment and the fourth compartment but a length more than that of the second compartment. The third compartment provides storage capacity for the user. The minor dividers may adjust their positions upon the major divider and the back to accommodate rods of different lengths. In an alternate embodiment, the lid has a hatch proximate one corner generally oriented over the third compartment 51. In a further alternate embodiment, a second major divider has a position inward from the first major divider 50. The second major divider in cooperation with the left side, the right side, and the first major divider forms a fifth compartment on a narrow elongated shape. The first compartment has its length to receive additional rolls of wrapping paper.

Figure 19:
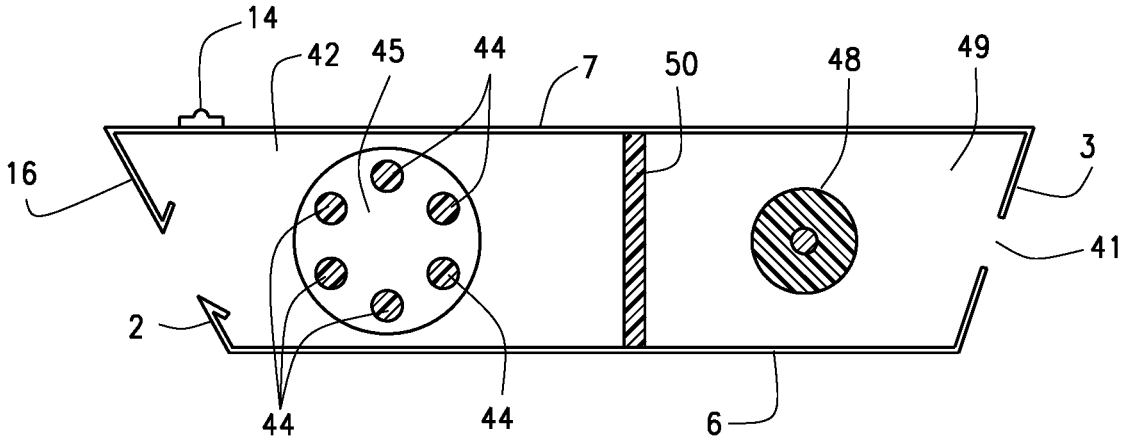
FIG. 19 is a sectional view of FIG. 11.

Looking at this preferred embodiment of the invention to assist the user in selecting stored wrapping paper, FIG. 19 then displays a sectional view of it the Magazine inwardly from the left side 4. The body has a volume defined by the base 6, the front 2, the lid 7, and the back 3. In this view the back 3 appears to the right and the front 2 has the grip 16 upon it here shown towards the left. Within that volume, the body has the spindle assembly with six spindles 44 shown equally spaced upon the holder 45 here shown into the plane of the figure. The holder has a generally round shape with apertures upon it that correspond to the spindles. The body has its volume and its main compartment 42 that has space for at least three and preferably six spindles as shown. The spindles, with the wrapping paper R rolled upon them, rotate individually for drawing out an edge of a roll for measuring and cutting. The drawing out occurs when a spindle is placed proximate the opening 10 in the front 2.

To the right of the holder 44, the main compartment 42 has its inner boundary at the main divider 50. The main divider has a generally centered location as shown. Rightward of the main divider, the second compartment has the rod 48 ready to receive rolls of ribbon and other materials. The rod has a round cross section as shown and a generally centered location upon the minor divider and within the second compartment.

Figure 20:
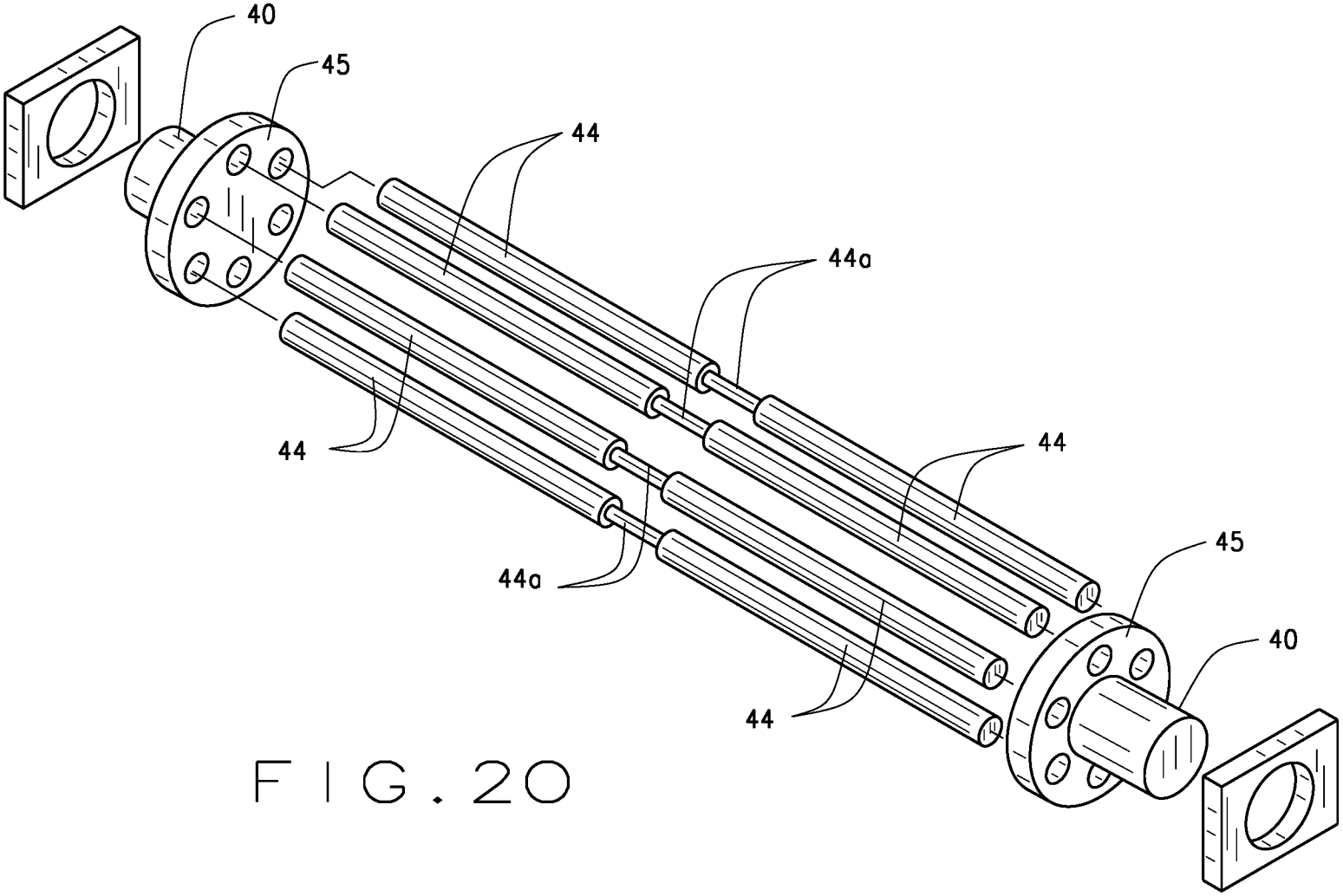
FIG. 20 is an exploded perspective view of an alternate embodiment of the spindle assembly of the invention.

FIG. 20 shows an alternate embodiment of the spindle assembly 43 of invention in an exploded view. The spindle assembly has two bearings 40 that connect to the left side and the right side respectively. The bearings permit the remainder of the spindle assembly to rotate upon a longitudinal axis through the spindles. Inwardly from the bearings, the assembly has the two holders 45. Each holder has a round, cylindrical shape, an inward face, and an outward face. The outward face orients towards the bearing and the inward face orients towards the spindles. The inward face has a plurality of apertures or other connection to receive the spindles. The inward face permits the spindles to independently rotate and display wrapping paper as selected by the user. Proximate the center of each spindle, a spindle has a slot 44*a*.

Figure 21:
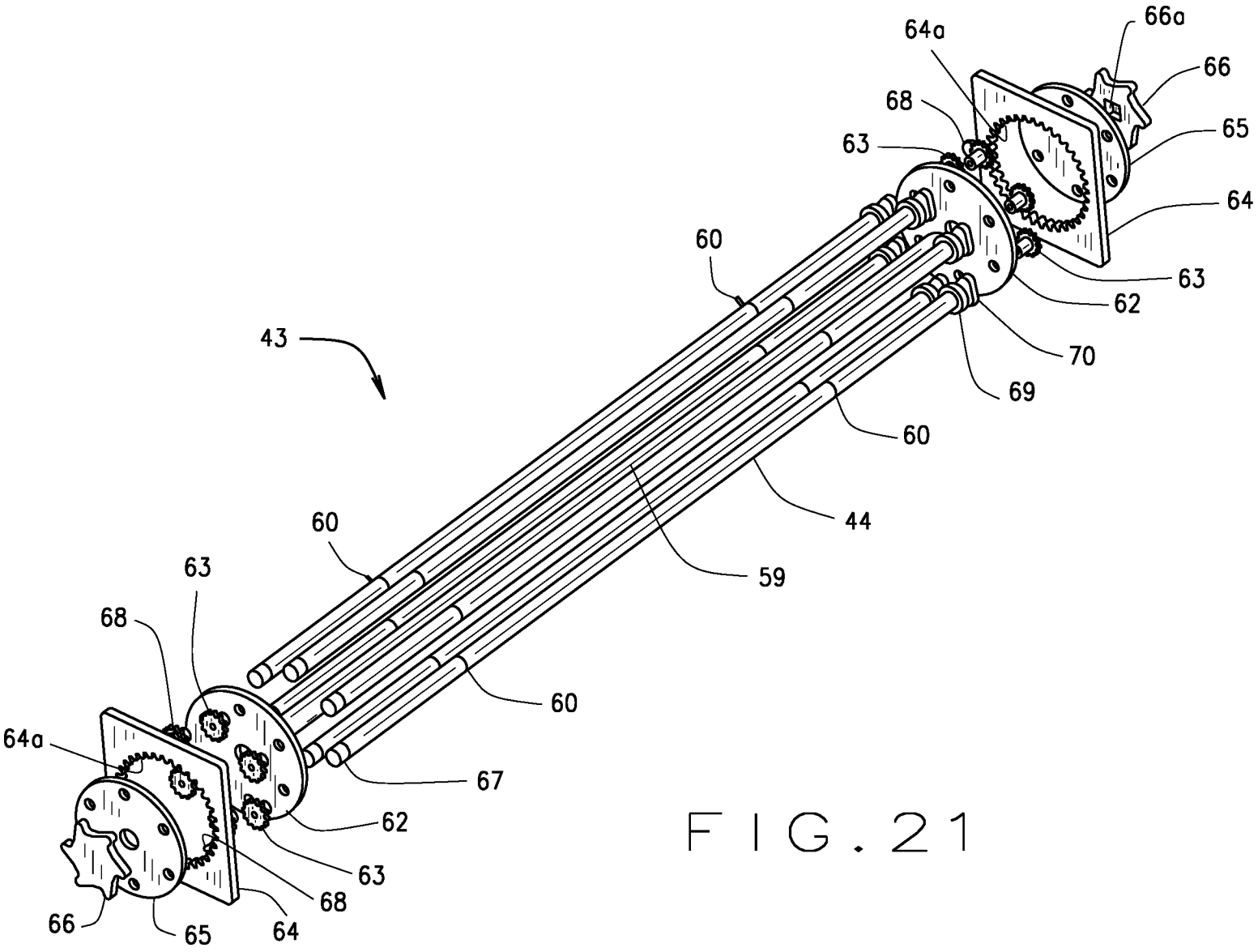
FIG. 21 is an exploded perspective view of the preferred embodiment the spindle assembly.

A preferred embodiment of the spindle assembly 43 of invention appears in FIG. 21 in an exploded view. The spindle assembly begins with a bar 59 generally elongated and slender with a square cross-section. The bar has its width and its length exceeds its width by at least a factor of ten. The bar has two opposite ends and each end fits into a cover 62. Thus the spindle assembly 43 has two covers, generally round and flat plates. The covers are mutually parallel and spaced apart by nearly the length of the bar 59. Outwardly of the bar, each cover receives at least three, here the figure shows six, spindles 44 regularly spaced around the bar. Each spindle has a generally elongated, slender, round cylindrical shape. The spindles each have a diameter similar the width of the bar 59. Each spindle has upon it at least one, here the figure shows two, grips 60. The grips fit upon the exterior surface of the spindles. Each grip has a ring like shape with at least one tab extending outwardly from the center of the grip. The at least one tab adjoins the interior surface of a roll R of wrapping paper. The tabs of the grips cooperate with the spindles so that the rolls R each rotate with their corresponding spindle as the assembly rotates but the grips permit a user to pull wrapping paper from roll mounted upon a spindle. The preferred embodiment also has the cutter 14 relocated to the front 2 above the opening 10.

Each spindle has two opposite ends, here the left end appears towards the left of the figure and the right end appears towards the right of the figure. The left end of each spindle has its end cap 67 press fit to the spindle. On the right end of each spindle, the spindle has its movable cap 69. The end cap 67 has a diameter similar to that of the spindle while the movable cap 69 has a diameter greater than that of the spindle. Upon each movable cap and outwardly from the spindle, the spindle has an end dock 70 that temporarily secures the movable cap to the spindle against rotation until released by the user. As mentioned above, the center bar 59 extends past the spindles 44 and the end docks 70 as it passes through another cover 62 here shown to the right. The cover has its round, flat, plate like shape as before with a square centered aperture 65*a* that admits the bar. The cover has a plurality of its own round apertures 65*b* spaced regularly upon it and to align with the end docks 67 of the spindles 44. The round apertures each admit a stem of a gear 63. The gear has a plurality of teeth radially extending therefrom and having an outer diameter similar to that of the end dock. Each end dock has a fixed position upon the cover and engages a recess in the movable cap 69 as later shown in FIG. 23. The movable cap detaches from the end dock so that a user may load a roll R upon a spindle for usage.

Here, the spindle assembly 43 shows six spindles 44 and thus six gears 63 extend from the right ends of the spindles into a rack 64. The rack has a flat, planar square shape with an internal toothed opening as at 64*a* that receives the gears 63 in mechanical cooperation. The rack has its width and height that fits into the main compartment 42 previously shown. Outwardly from the rack, the spindle assembly has a round plate 65 also with its round apertures 65*b* spaced regularly upon it that align with the stems of the gears 63. Centered within the round apertures, the plate has its centered square aperture 65*a* that admits an end of the bar 59. The bar then extends beyond the plate and engages a receptacle 66*a* in a knob 66. The knob has a plurality of vanes upon its perimeter for a user to grasp when turning the knob during usage. The knob, its vanes, and indicia nearby guide a user to rotate the knob in one direction, here clockwise. Slightly outward from the center of the knob, the rack 64 also has at least one ratchet pawl 68 pivotally attached to it and that engages a nearby gear 63. The pawl allows a user to rotate one spindle in one direction but not the other during usage. The pawl then allows one gear to pass as the spindle assembly rotates in one direction thus preventing a user from rotating the spindle assembly in both directions.

Opposite the right ends of the spindles, the left of this figure shows six gears 63 also extending from the left ends of the spindles into a rack 64. The rack has its flat, planar square shape as before with an internal toothed opening as at 64*a* that receives the gears 63 in mechanical cooperation. The rack has its width and height that fits into the main compartment 42 previously shown. Outwardly from the rack, the spindle assembly has a round plate 65 also with its round apertures 65*b* spaced regularly upon it that align with the stems of the gears 63. Centered within the round apertures, the plate its centered square aperture 65*a* that admits the other end of the bar 59. The bar then extends beyond the plate and engages a receptacle 66*a* in the other knob 66. This knob has a plurality of vanes upon its perimeter for a user to grasp when turning the knob during usage. This knob is a mirror image of the other knob. This knob, like the other, has vanes and nearby indicia that a user to rotate the knob in one direction, here counter-clockwise so that the spindles as a group rotate up and to the left in the figure. Slightly outward from the center of the knob, the rack 64 also has at least one ratchet pawl 68 pivotally attached to it and that engages a nearby gear 63 using the tip of the pawl 68. The pawl allows a user to rotate one spindle in one direction only as described so that wrapping paper remains upon the rolls. The pawl then allows one gear to pass as the spindle assembly rotates in one direction thus preventing a user from rotating the spindle assembly in both directions.

Figure 22:
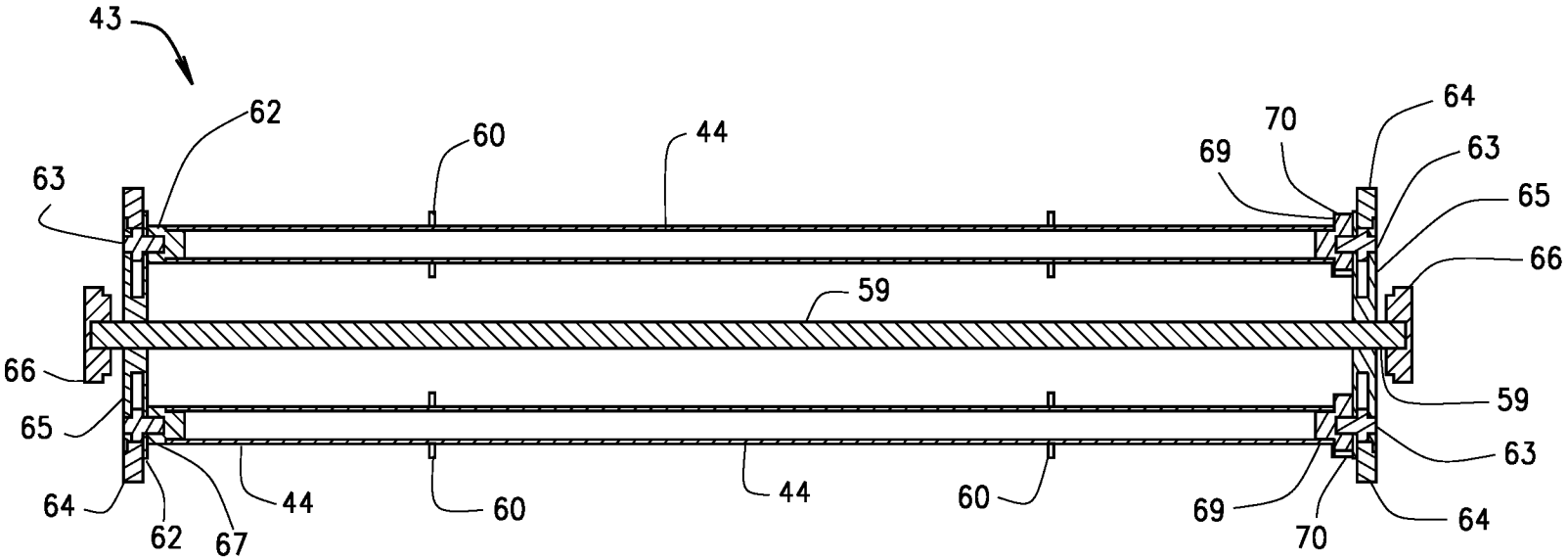
FIG. 22 is a sectional view of the preferred embodiment the spindle assembly; and, FIG. 23 is a detailed view of a movable end cap and its dock.

FIG. 22 has a sectional view through the preferred embodiment of the spindle assembly 43. From the left of the figure, the assembly has a knob 66 connected to an end of the center bar 59. The center bar passes through a gear plate 65 fitted within a gear rack 64. The gear rack has internal teeth 64*a* upon forming a race. The internal teeth cooperatively engage the teeth of at least three gears 63, though two gears are shown on edge in this figure. The gears have stems that extend through a cover 62 and into end caps 67 of the spindles 44. In this embodiment, the spindles have a hollow tubular construction and the end caps 67 fit into that tubular form. The spindles and the center bar then extend for their respective lengths, the bar being longer towards the right of the figure. Each spindle has its right end with a moveable cap 69 temporarily secured by an end dock 70. The moveable cap fits into the tubular construction of a spindle and then widens outwardly to engage the dock 70. Stems from gears 63 extend from the moveable caps through another gear cover 62 and then position the gears 63 to operatively engage with the internal teeth 64*a* of the rack 64. The stems lastly extend into the gear plate 65. The gear plate has its center square aperture 65*a* that admits the bar 59 for the last of its length to the receptacle 66*a* of the knob 66 on the right of the figure.

Figure 23:
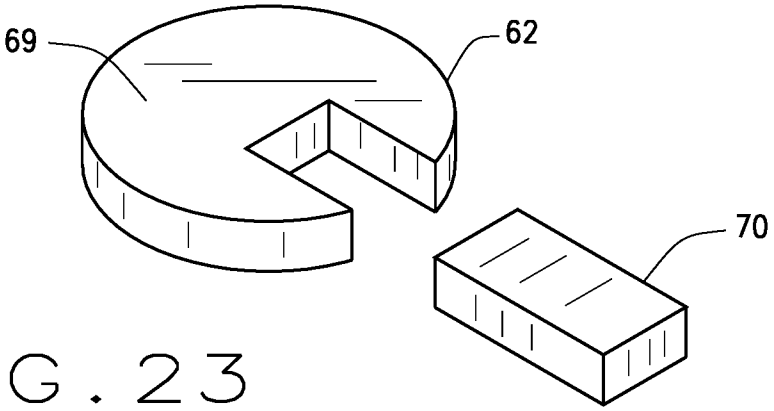

And, FIG. 23 shows a detailed view of the right end of a spindle previously shown in FIGS. 21, 22. The assembly 43 has its covers 62 generally round in shape. Regularly spaced around the cover, the cover has at least three, and preferably, six docks 70. The docks have a connection to the cover and an elongated rectangular shape. A dock then fits into a corresponding recess in the movable end cap 69, similar to a keyway. The movable end cap thus connects to the dock during usage and storage of the invention. When a roll R exhausts it paper, a user then rotates the assembly using the knobs so that the empty roll reaches the top of the assembly in the 60. The user grasps the spindle with the empty roll and gently detaches the moveable cap from the dock. The user then pulls the end cap 67 of its gear 63 and the spindle from the assembly for receiving a new roll of wrapping paper.

The preferred embodiment has a spindle assembly with a centered square shaft and six spindles equally spaced about the shaft and parallel to the shaft. The shaft has an elongated, slender shape, a square cross section, a length, and two opposite ends. Outside of the shaft, the assembly has two mutually parallel and spaced apart covers. Each cover has a flat, round shape and each of the ends of the shaft connects to one cover. Each of the spindles have an elongated, slender, cylindrical shape, a left end and an opposite right end, an end cap upon the left end and a movable cap upon the right end, and at least one grip. The cylindrical shape is round. Each of the covers has a center square aperture to receive the shaft and round apertures in registration with each of the spindles. The round apertures receive six gears and each of the gears enters one of the round apertures of one cover and connects to each of the end caps. The gears on this first cover have a coplanar arrangement. Then a further set of six gears enter the round apertures of the other cover and connect to each of the movable caps. This further set of gears also have a coplanar arrangement that has a mutually parallel orientation to the first set of six gears.

Outwardly from the gears and the covers, the assembly has two mutually parallel and spaced apart racks, each of the racks has a rounded internal opening. The opening has a teeth that extending radially inward. The teeth of one rack mesh with the six gears and the teeth of the other rack mesh with the second, or further, set of six gears. The gears in cooperation with the racks allow the spindles to rotate simultaneously and in the same direction. The spindle assembly rotates in one direction only as shown by the vanes upon the knobs in the drawings. Before the knobs and outside of the racks, the assembly has two mutually parallel and spaced apart plates. Each plate has a flat, round shape and a center square aperture that receives the shaft. Outward from the square aperture, each plate has round apertures in registration with the counterpart round apertures in one of the covers. One plate receives six of the gears entering one set of the round apertures. Then the other plate receives the further set of six of the gears. Each the gears enters one of the round apertures. Before leaving the covers, each of the racks has at least one pawl operatively engaging one of the gears for one direction rotation.

The shaft extends outwardly through the center square aperture of each plate. The shaft then engages the knobs. The assembly has two knobs, one of the knobs connecting to the shaft proximate one plates, and the other knob connecting to the shaft at the other plate opposite the first knob. The knobs cooperate with the plates, the racks, the gears, and the covers to rotate the spindle assembly as a user turns at least one of the knobs. More closely, the assembly also has six rectangular docks arrayed upon one cover in registration with the movable caps of the spindles. Each of the movable caps then has a rectangular recess that receives one of the docks in cooperative engagement. This dock and movable cap engagement keeps the movable cap upon the dock during usage until a user separates the movable cap from the dock for loading wrapping paper upon one of the spindles or for removing an empty tube from a spindle.

The spindle assembly presents a selected roll to a user of the invention. Each spindle lets a user release wrapping paper from a selected roll upon pulling, ready to wrap a present or other object resting upon the lid above.

From the aforementioned description, a magazine has been described. The magazine is uniquely capable of storing many rolls of wrapping paper horizontal while rotating the rolls for selection by a user. The magazine and its various components may be manufactured from many materials, including but not limited to, transparent polymers, steel, aluminum, opaque polymers, ferrous and non-ferrous metal foils, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device for storing wrapping paper horizontally, said device comprising:

a body, said body having a width:

a spindle assembly within said body and oriented parallel to the width of said body;

said spindle assembly having at least three spindles:

a lid placed upon said body over said spindle assembly:

said body having a front and a spaced apart opposite back, a left side and a mutually parallel and spaced apart right side, said left side and said right side being perpendicular to said front, said front, said back, said left side, and said right side joining to a planar base:

said front having an opening therethrough providing access to said spindle assembly;

said lid resting upon said, front, said back, said left side, and said right side;

said front having a width and said back having a width similar to that of said front;

a major divider spanning from said left side to said right side and from said base upwardly, said major divider forming a main compartment receiving said spindle assembly;

at least one minor divider spanning from said back to said major divider and from said base upwardly, said at least one minor divider forming a second compartment receiving a rod, said rod spanning from said at least one minor divider towards said left side; and, said back having a second opening therethrough of less than half the width of said back, said second opening providing access to said rod.

2. The wrapping paper storing device of claim 1 further comprising:

two mutually parallel and spaced apart minor dividers;

a third compartment between one of said minor dividers and said right side;

a fourth compartment between the other of said minor dividers and said left side; and, said third compartment and said fourth compartment being outward of said second compartment.

3. A device for storing wrapping paper horizontally, said device comprising:

a body, said body having a width;

a spindle assembly within said body and oriented parallel to the width of said body;

said spindle assembly having six spindles;

a lid placed upon said body over said spindle assembly;

said body having a front and a spaced apart opposite back, a left side and a mutually parallel and spaced apart right side, said left side and said right side being perpendicular to said front, said front, said back, said left side, and said right side joining to a planar base;

said front having an opening therethrough providing access to said spindle assembly;

said lid resting upon said front, said back, said left side, and said right side;

said spindle assembly having two spaced apart round holders, each of said holders having a cylindrical shape, said holders being mutually parallel and receiving said at three spindles between them equally spaced about said holders, and two bearings positioned outwardly of said holders and abutting said left side and said right side;

each of said spindles adapted to receive a roll of wrapping paper;

each of said spindles having two ends and a cap upon each end, said caps engaging said holders, one of said caps of each of said spindles releasing from said holder, wherein each of said spindles is adapted to receive a roll of wrapping paper.

4. A device for storing wrapping paper, said device having a body with, a width, the body having a front and a spaced apart opposite back, a left side and a mutually parallel and spaced apart right side, the left side and the right side being perpendicular to the front; the front, the back, the left side, and the right side joining to a planar base, an opening through the front providing access within the body, a lid placed upon the body and resting upon the front, the back, the left side, and the right side. wherein the improvement comprises:

a spindle assembly within said body and oriented parallel o the width of said body;

said spindle assembly having a centered shaft and at least three spindles, said at least three spindles equally spaced about said shaft and parallel to said shaft;

wherein said spindle assembly is adapted to present a selected roll to a user of said device;

wherein each of said spindles is adapted to release paper from a selected roll upon pulling by a user;

said shaft having an elongated, slender shape, a square cross section, a length, and two opposite ends;

two mutually parallel and spaced apart covers;

each of said ends of said shaft connecting to one cover;

each of said at least three spindles having an elongated, slender, cylindrical shape. a left end and an opposite right end, an end cap upon said left end and a movable cap upon said right end; and, at least one grip upon each of said at least three spindles.

5. The wrapping paper storing device of claim 4 further comprising:

each of said covers having a center square aperture to receive said shaft and a plurality of round apertures in registration with each of said at least three spindles;

at least three gears, each of said at least three gears entering of one said round apertures of one cover and connecting to each of said end caps, said at least three gears being coplanar;

at least three other gears, each of said at least three other gears entering of one said round apertures of the other cover and connecting to each of said movable caps, said at least three other gears being coplanar and mutually parallel to said at least three gears;

two mutually parallel and spaced apart racks, each of said racks having a rounded internal opening, said opening having a plurality of teeth extending radially inward;

wherein the plurality of teeth of one rack mesh with said at least three gears;

wherein the plurality of teeth of one rack mesh with said at least three gears; and, said at least three spindles rotate simultaneously and in the same direction and said spindle assembly rotates in one direction.

6. The wrapping paper storing device of claim 5 further comprising:

each of said covers having a flat, round shape;

two mutually parallel and spaced apart plates, each of said plates having flat, round shape;

each of said plates having a center square aperture to receive said shaft and a plurality of round apertures in registration with said plurality of round apertures in one of said covers;

one of said plates receiving said at least three gears, each of said at least three gears entering of one said round apertures of one of said plates;

the other of said plates receiving said at least three other gears, each of said at least three other gears entering of one said round apertures of the other of said plates; and, said shaft extending outwardly through the center square aperture of each plate.

7. The wrapping paper storing device of claim 5 further comprising:

each of said racks having at least one pawl operatively engaging one of said at least three gears and one of the other of said at least three gears respectively.

8. The wrapping paper storing device of claim 7 further comprising:

two knobs, one of said knobs connecting to said shaft proximate one of said plates, and the other of said knobs connecting to said shaft proximate the other of said plates; and, said knobs cooperating with said plates, said racks, said gears, and said covers rotate said spindle assembly as a user turns at least one of said knobs.

9. The wrapping paper storing device of claim 4 further comprising:

at least three docks arrayed upon one cover in registration with said movable caps of said at least three spindles;

each of said movable caps having a recess that receives one of said at least three docks; and, each of said recesses having a shape cooperatively engaging a shape of one of said at least three docks wherein said movable cap remains upon said dock during usage until a user separates said movable cap form said dock for loading wrapping paper upon one of said at least three spindles.

10. A device for storing wrapping paper comprising:

a spindle assembly, having a centered square shaft and six spindles equally spaced about said shaft and parallel to said shaft;

said shaft having an elongated, slender shape, a square cross section, a length, and two opposite ends;

two mutually parallel and spaced apart covers, each cover having a flat, round shape;

each of said ends of said shaft connecting to one cover;

each of said spindles having an elongated, slender, cylindrical shape, a left end and an opposite right end, an end cap upon said left end and a movable cap upon said right end, and at least one grip;

each of said covers having a center square aperture to receive said shaft and a plurality of round apertures in registration with each of said spindles;

six gears, each of said gears entering of one said round apertures of one cover and connecting to each of said end caps, said gears being coplanar;

a further six gears, each of said gears entering of one said round apertures of the other cover and connecting to each of said movable caps, said gears being coplanar and mutually parallel to the first of said six gears;

two mutually parallel and spaced apart racks, each of said racks having a rounded internal opening, said opening having a plurality of teeth extending radially inward;

wherein the plurality of teeth of one rack mesh with said six gears and the plurality of teeth of the other rack mesh with the further said six gears;

wherein said spindles rotate simultaneously and in the same direction and said spindle assembly rotates in one direction;

two mutually parallel and spaced apart plates, each of said plates having flat, round shape;

each of said plates having a center square aperture to receive said shaft and a plurality of round apertures in registration with said plurality of round apertures in one of said covers;

one of said plates receiving six of said gears each of said gears entering of one said round apertures of one of said plates;

the other of said plates receiving the further six of said gears and each of said gears entering of one said round apertures of the other of said plates;

said shaft extending outwardly through the center square aperture of each plate;

each of said racks having at least one pawl operatively engaging one of said gears;

two knobs, one of said knobs connecting to said shaft proximate one of said plates, and the other of said knobs connecting to said shaft proximate the other of said plates, said knobs cooperating with said plates, said racks, said gears, and said covers to rotate said spindle assembly as a user turns at least one of said knobs;

six rectangular docks arrayed upon one cover in registration with said movable caps of said spindles;

each of said movable caps having a rectangular recess that receives one of said docks in cooperative engagement wherein said movable cap remains upon said dock during usage until a user separates said movable cap form said dock for loading wrapping paper upon one of said at least three spindles;

wherein said spindle assembly is adapted to present a selected roll to a user of said device; and, wherein each of said spindles is adapted to release wrapping paper from a selected roll upon pulling by a user.

11. The wrapping paper storing device of claim 10 further comprising a body having a width;

said spindle assembly locating within said body and oriented parallel to the width of said body;

a lid placed upon said body over said spindle assembly;

said body having a front and a spaced apart opposite back, a left side and a mutually parallel and spaced apart right side, said left side and said right side being perpendicular to said front, said front, said back. said left side, and said right side joining to a planar base;

said front having an opening providing access to said spindle assembly;

said lid resting upon said front, said back, said left side, and said right side;

said front having a width and said back having a width similar to that of said front;

a major divider spanning from said left side to said right side and from said base upwardly, said major divider forming a main compartment receiving said spindle assembly;

at least one minor divider spanning from said back to said major divider and from said base upwardly, said at least one minor divider forming a second compartment receiving a rod, said rod spanning from said at least one minor divider towards said left side; and, said back having a second opening of less than half the width of said back, said second opening providing access to said rod.

* * * * *